US012728335B2

(12) United States Patent
Gibbons

(10) Patent No.: US 12,728,335 B2
(45) Date of Patent: Sep. 8, 2026

(54) ATHLETIC SWING TRAINING DEVICE

(71) Applicant: Power L Hitting, LLC, Dover, DE (US)

(72) Inventor: Jay Gibbons, Thousand Oaks, CA (US)

(73) Assignee: Power L Hitting, LLC, Dover, DE (US)

( * ) Notice: Subject to any disclaimer, the term of this patent is extended or adjusted under 35 U.S.C. 154(b) by 82 days.

(21) Appl. No.: 17/931,490

(22) Filed: Sep. 12, 2022

(65) Prior Publication Data

US 2024/0082674 A1 Mar. 14, 2024

(51) Int. Cl.
*A63B 69/00* (2006.01)

(52) U.S. Cl.
CPC ..... *A63B 69/0059* (2013.01); *A63B 69/0002* (2013.01); *A63B 2069/0008* (2013.01); *A63B 2225/09* (2013.01)

(58) Field of Classification Search
CPC ..... A63B 69/0059; A63B 69/0002; A63B 2069/0008
USPC ..... 473/458, 422, 482
See application file for complete search history.

(56) References Cited

U.S. PATENT DOCUMENTS 594,865 A * 12/1897 Fortney ..... A61F 5/0123 602/16
4,524,764 A * 6/1985 Miller ..... A61F 5/0123 602/26
4,732,143 A * 3/1988 Kausek ..... A61F 5/0123 602/16
4,911,728 A * 3/1990 Rigel ..... A63B 69/0059 473/458
5,472,206 A * 12/1995 Manley ..... A63B 69/0059 473/214
5,865,695 A * 2/1999 Mahala ..... A63B 69/0071 473/450
5,954,621 A * 9/1999 Joutras ..... A63B 21/4005 482/8
6,001,075 A * 12/1999 Clemens ..... A61F 5/0123 602/26
7,048,704 B2 5/2006 Sieller et al.
7,128,658 B2 10/2006 DuFour
8,292,760 B2 * 10/2012 Johnson ..... A63B 69/0059 473/458
8,601,734 B1 * 12/2013 Hopkins ..... F41C 23/14 42/71.01
10,561,917 B1 * 2/2020 Naro ..... A63B 69/0071 473/450
10,702,401 B2 * 7/2020 Burke ..... A61F 5/0123
10,918,927 B2 * 2/2021 Canseco ..... A61F 5/013 473/458

* cited by examiner

*Primary Examiner* — Mitra Aryanpour
(74) *Attorney, Agent, or Firm* — Buchalter

(57) ABSTRACT

An orthotic device having first and second support members, pivotally connected to each other, so as to prevent the angle between the first and second support members from forming an angle of less than 90 degrees relative to each other. The device is also configured to allow the first and second support members to freely pivot to any angle between 90 degrees and 270 degrees relative to each other. The orthotic device is adapted to be worn by an athlete in order to facilitate proper arm angle and swing path when swinging a baseball bat, softball bat, or any other similar athletic equipment.

6 Claims, 9 Drawing Sheets

ATHLETIC SWING TRAINING DEVICE

BACKGROUND

1. Field of the Invention

The present invention relates to sports swing training devices. More particularly the invention relates to a device that assists in training baseball and softball hitters in proper positioning of the arms and hands while hitting. The invention comprises a brace that positions a hitter's arm in the correct angle during the swing so that the arm does not collapse and cause undesirable movement during the swing.

2. Description of the Related Art

Due to baseball's immense popularity over the last 150 years, there have been prior attempts to train hitters in proper swing techniques. Although most such attempts rely on in-person instruction, there have been attempts to provide equipment or devices that will assist in swing training. However, prior attempts at such devices typically result in cumbersome devices that require multiple people to calibrate and properly position prior to training, or that contain many moving parts, or that otherwise have undesirable aspects or that may impart poor habits to the subject of the training.

For example, U.S. Pat. No. 7,048,704 to Sieller, and U.S. Pat. No. 7,128,658 to DuFour both describes an orthotic devices or braces that can be attached to an athlete's upper body. However, both Sieller and DeFour the use of a tensioning strap that must be threaded through and around a number of hooks and guide members (in the case of Sieller) or attached to hitting equipment and tensioned properly (in the case of DuFour). These and other similar devices thus have downsides because of their complicated setup, often requiring outside assistance, and because the use of a tensioning strap contributes to the development of poor swing habits as the athlete tenses his upper body while using the devices.

Other attempts at swing training devices are very simple, yet suffer from multiple drawbacks. For example, one method involves the player holding a playground ball or a beach ball between the forearm and bicep, or between the chest and forearm while swinging. This method introduces a new drawback as the training ball often drops and bounces away and must be retrieved between swings. This method and device also introduces the same "tension" problem as it teaches the athlete to tension their arms during the swing, rather than to be flexible during the swing.

BRIEF SUMMARY OF THE INVENTION

Accordingly, the present invention provides a wearable orthotic device that teaches an athlete to maintain proper arm position while swinging a bat or similar athletic equipment, while also teaching the athlete to maintain a loose, flexible posture during the swing.

A recurring problem when training an athlete to hit a baseball is that hitters often tend to position their arms at undesirable angles. This is especially true for young athletes, or athletes who are new to the game.

Most trainers agree that the best hitting posture is for the hitter to position the back arm with a bend of approximately 90° prior to beginning the swinging motion. That is, the angle formed at the elbow between the forearm and the upper arm of the back arm should be 90°. Then, during the swing, the most successful hitters will drop the back shoulder, tucking the back elbow in toward the ribcage, the hands remaining high. This positions the bat in the proper swing plane to maximize the change for good contact with the ball. During the first portion of the swing, the back arm of the hitter remains at approximately 90° bend. As the hitter completes the swing, the back arm should be allowed to freely extend out straight, with the angle formed at the elbow between the forearm and upper arm being approximately 180°.

New hitters often develop bad swing habits that include holding their back arm at too acute an angle, folding their forearm back to rest on the upper arm or shoulder prior to the swing. This in turn places the back arm out of position when the swing starts and makes it difficult to position the bat on the preferred swing plane.

The present invention addresses this swing flaw by training the hitter to hold the back arm at 90°, while also allowing the back arm to move freely without resistance or tension during the swing. Unlike prior art devices, the present invention does not introduce tension through resistance bands or the like in order to force the back arm into position. By introducing resistance, prior art devices teach the hitter to tense the back arm, which results in poor swing form.

In one embodiment, the device teaches an athlete to have a proper spacing between their back bicep and forearm while swinging a baseball bat. In one embodiment, the device comprises an orthotic device that is wearable on the athlete's arm, extending between approximately the bicep and the mid-forearm area. The device is attached to the athlete using a plurality of adjustable straps, and comprises two main brace portions. When worn on the athlete's back arm, the first brace portion is positioned on the upper arm, with at least one strap wrapping around the athlete's bicep and triceps to secure the upper portion of the brace. The second brace portion is position on the forearm, with at least one strap wrapping around the athlete's forearm to secure the second brace portion. The first and second brace portions are joined at a pivot joint that is located at the athlete's elbow when worn. The pivot joint is configured such that device extends between 90° and 180° during use. In other words, the device when worn is in an L-shape when the athlete is in a ready position before swinging, and the device extends out to a straight line configuration during the swing.

Another flaw often seen in a swing is a tendency for the hitter to lock out the front arm during the swing, known as an arm bar. In this scenario, the hitter's front arm extends out in a straight line away from the body, rather than maintaining the front arm bent at an angle during the swing. The arm bar of the front arm results in the bat path being flat or slightly downward, increasing the likelihood of poor contact. A second bad outcome with front arm bar is increased bat drag, inhibiting acceleration of the bat through the ball. Thus, unlike the back arm, it is desirable to prevent the front arm from locking out in an arm bar during the swing.

In another embodiment, the device is worn on the front arm of an athlete swinging a baseball bat, where the device and front arm form an L-shape prior to beginning the swing. In this embodiment, the device may also include a strap extending between the first brace portion and the second brace portion. During the swing, the strap prevents the front arm from locking out in a straight line, thereby preventing or rehabilitating undesirable swing habits. The strap is adjustable such that the front arm can be stopped at a desired angle less than 180 degrees during the swing.

It should be noted that although the description of the invention makes reference to use with a baseball bat, the invention is also advantageously used in training for other sports that require a similar swing, such as softball or other sports that involving swinging and hitting equipment. It should be understood that the terms "athlete" or "hitter" are intended to be interchangeable in this description. The term "proximal" shall mean the end closest to the hitter's shoulder, and the term "distal" shall mean the end closest to the hitter's hand.

While preferred embodiments of the present invention have been described above, it will be obvious to those skilled in the art that such embodiments are provided by way of example only. Numerous variations, changes, and substitutions will now occur to those skilled in the art without departing from the invention. These and other embodiments of the present invention will become apparent to those skilled in the art from a consideration of the following detailed description taken in combination with the accompanying drawings and by the elements, features, and combinations particularly pointed out in the claims.

BRIEF DESCRIPTION OF THE DRAWINGS

Example embodiments will be described and explained with additional specify and detail through the use of the accompanying drawings.

DETAILED DESCRIPTION OF THE INVENTION

While certain embodiments have been provided and described herein, it will be readily apparent to those skilled in the art that such embodiments are provided by way of example only. It should be understood that various alternatives to the embodiments described herein may be employed, and are part of the invention described herein.

The present invention provides a wearable orthotic device for use on the arm for training an athlete to maintain proper arm position while swinging a bat or similar athletic equipment, while also teaching the athlete to maintain a loose, flexible posture during the swing.

Figure 1:
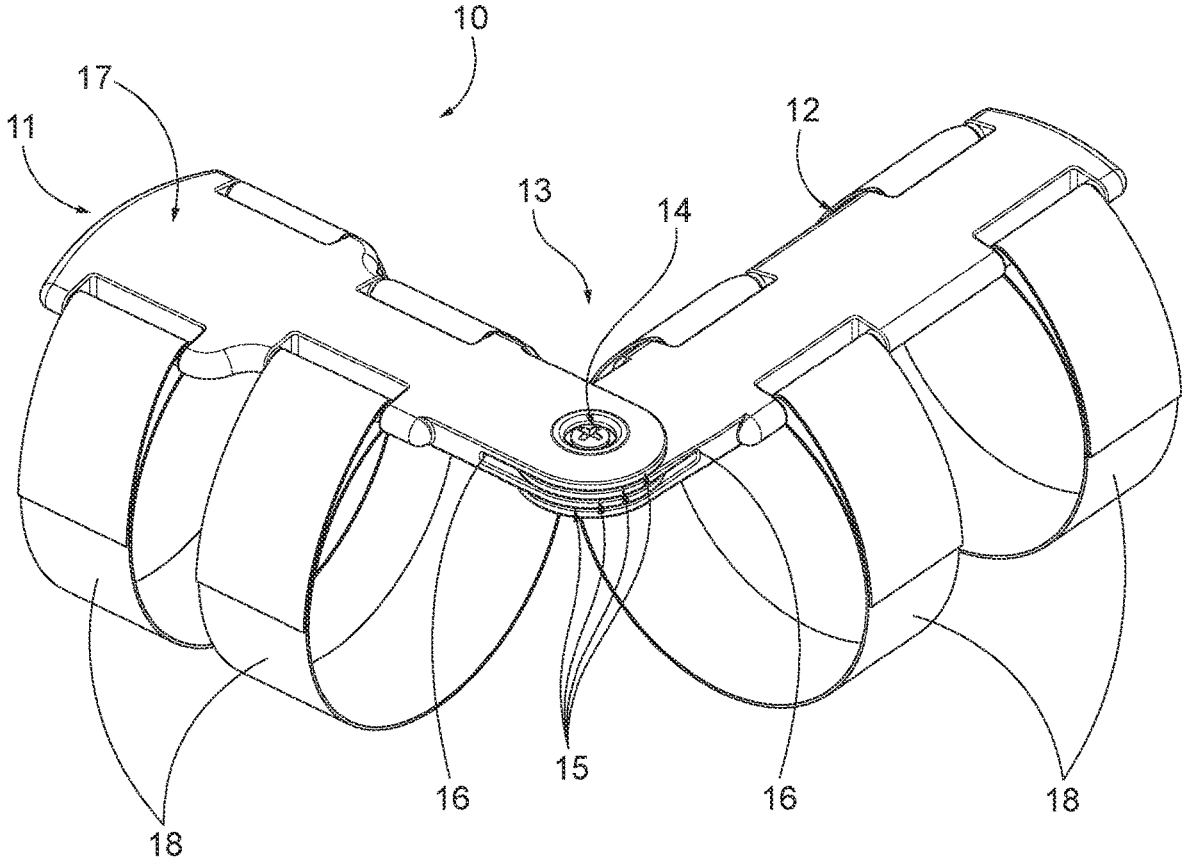
FIG. 1 is a perspective view of an embodiment of the invention, showing the device in the L position.

An exemplary embodiment of the orthotic device 10 shown in FIG. 1 includes a first support member 11 and a second support member 12 joined at a pivot joint 13, located approximately at the midpoint of the length of the device 10. The pivot joint 13 includes a pivot 14, as well as interlocking fingers 15 and slots 16.

In a preferred embodiment, the first support member 11 includes an enlarged portion 17 at the proximal end. The first support member 11 and the second support member 12 also each include one or more straps 18 for attaching the orthotic device 10 to the hitter's arm. In alternative embodiments, the straps may be replaced by other suitable retaining means, such as a sleeve made of neoprene or similar material. Although FIG. 1 shows the device with two straps 18 attached to each support member, it is also likely that the device could be used with a greater or lesser number of straps. For example, a hitter may choose to use two straps on the first support member 11 (corresponding to the upper arm) and only one strap on the second support member 12 (corresponding to the forearm). The ability to change the size and number of straps used with the device allow the device to be universal in that it can be used with children with arms that are smaller in both diameter and length, and by adults with larger arms.

In the embodiment shown in FIG. 1, the first support member 11 and second support member 12 fit together via a pivot joint 13 comprising a number of fingers 15 and slots 16 that intermesh and are secured by a pin, screw, bolt, post, rivet or similar member 19 running through the pivot point 14. As described below, the intermeshed pivot joint operates to stop the first and second support members from collapsing to an angle less than the desired 90° angle.

Figure 2:
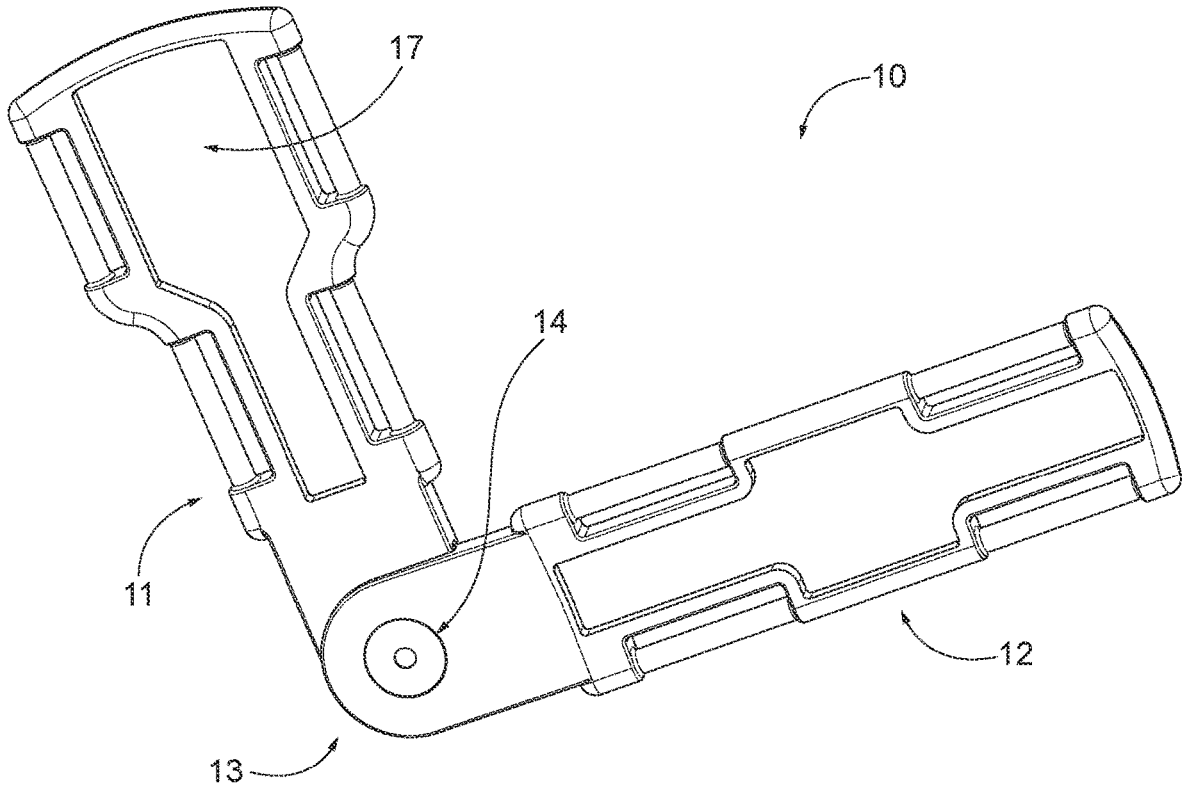
FIG. 2 is a side view of the brace portions of an embodiment of the invention in the L position.

As shown in FIG. 2, the device 10 locks in an L-shape position when the first support member 11 and second support member 12 are rotated about the pivot joint 13 in one extreme direction. The position in FIG. 2 represents how the device 10 would be positioned when the hitter's arm is in the ready position prior to swinging the bat.

The proximal end of the first support member preferably includes an enlarged portion 17. Because the enlarged portion 17 is approximately twice the width of the lower portion of the first support member, the enlarged portion 17 provides additional stability to the device as it is positioned over the hitter's upper arm, which tends to have a larger diameter than the portion of the hitter's arm that is covered by the rest of the device. In an alternative embodiment, the enlarged portion may be omitted. In another alternative embodiment, both the first and the second support members may include an enlarged portion.

It should be noted that FIG. 2 depicts an exemplary shape of the support members 11, 12. However, the support members need not conform to the shape depicted in FIG. 2. For example, the first support member 11 may have an elliptical, oval, trapezoidal, or other suitable shape, and still be within the scope of the invention.

Figure 6:
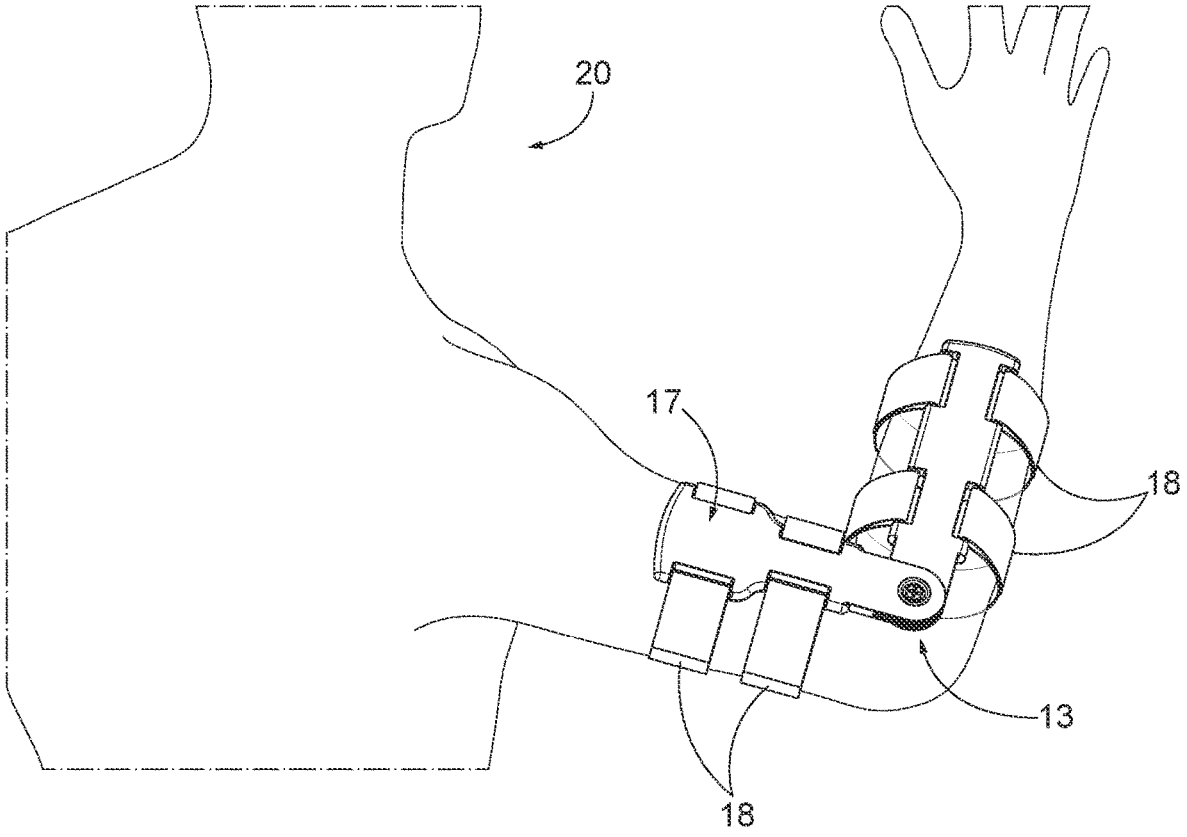
FIG. 6 is a perspective view of the invention as worn on the back arm of a right-handed hitter.

As shown in FIG. 2, the device is in the L position as it would be seen while worn on the back arm of a right-handed hitter. In this embodiment, the back shoulder would be located above the enlarged portion 17, and the hitter's right hand would be located beyond the distal end of the second support member 12, as depicted in FIG. 6. However, the pivot joint is configured such that the two brace portions may freely rotate between the 90° right-hand L-shape shown here, and may also rotate all the way through to 270° to form a left-hand L-shape. As with the right-hand L-shape, the left-hand L-shape stops when the two support members form a right angle with respect to each other. In this way, the invention is universal in that it can be used by a right-handed or left-handed player, and may also be placed on the front arm or the back arm of a hitter. The use of the device on the front arm is discussed in more detail below.

Most trainers agree that the best hitting posture is for the hitter to position the back arm with a bend of approximately 90° prior to beginning the swinging motion. This is the position depicted in FIG. 1. The angle formed at the elbow between the forearm and the upper arm of the back arm should be 90°. This 90° angle is encouraged by the device, which locks the arms at 90° and prevents the hitter from collapsing the arm to an angle less than 90°.

Then, during the swing, the most successful hitters will drop the back shoulder, tucking the back elbow in toward the ribcage, the hands remaining high. This positions the bat in the proper swing plane to maximize the change for good contact with the ball. During the first portion of the swing, the back arm of the hitter remains at approximately 90° bend.

Figure 3:
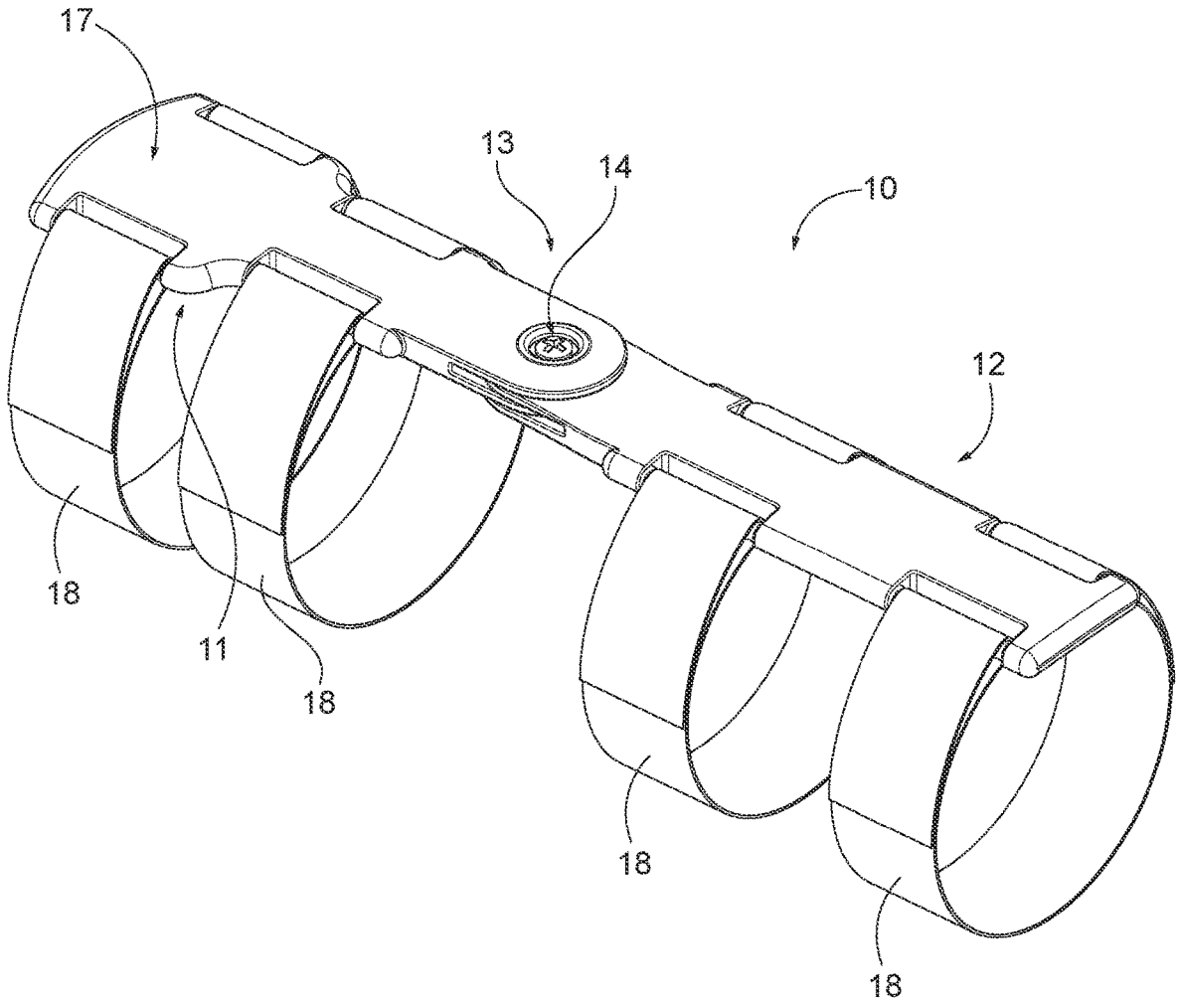
FIG. 3 is a side view of the invention in the extended position.

As the hitter completes the swing, the back arm should be allowed to freely extend out straight, with the angle formed at the elbow between the forearm and upper arm being approximately 180°. As depicted in FIG. 3, the device is capable of freely extending out to an open or extended position such that the angle formed by the first support member 11 and the second support member 12 is 180°. In fact, because there is nothing to stop the support members from continuing to pivot, the brace can extend outward at an angle beyond 180°, although in practical use the angle will be limited by the inability of the hitter's arm to extend beyond 180°.

The ability of this invention to allow free movement between 90° and 180° is an improvement over the prior art which uses resistance bands or straps to prevent the arms from freely moving, or which use a beach ball or similar to device to cause the hitter to maintain the 90° angle, but at the cost of introducing tension and bad swing habits.

Figure 4:
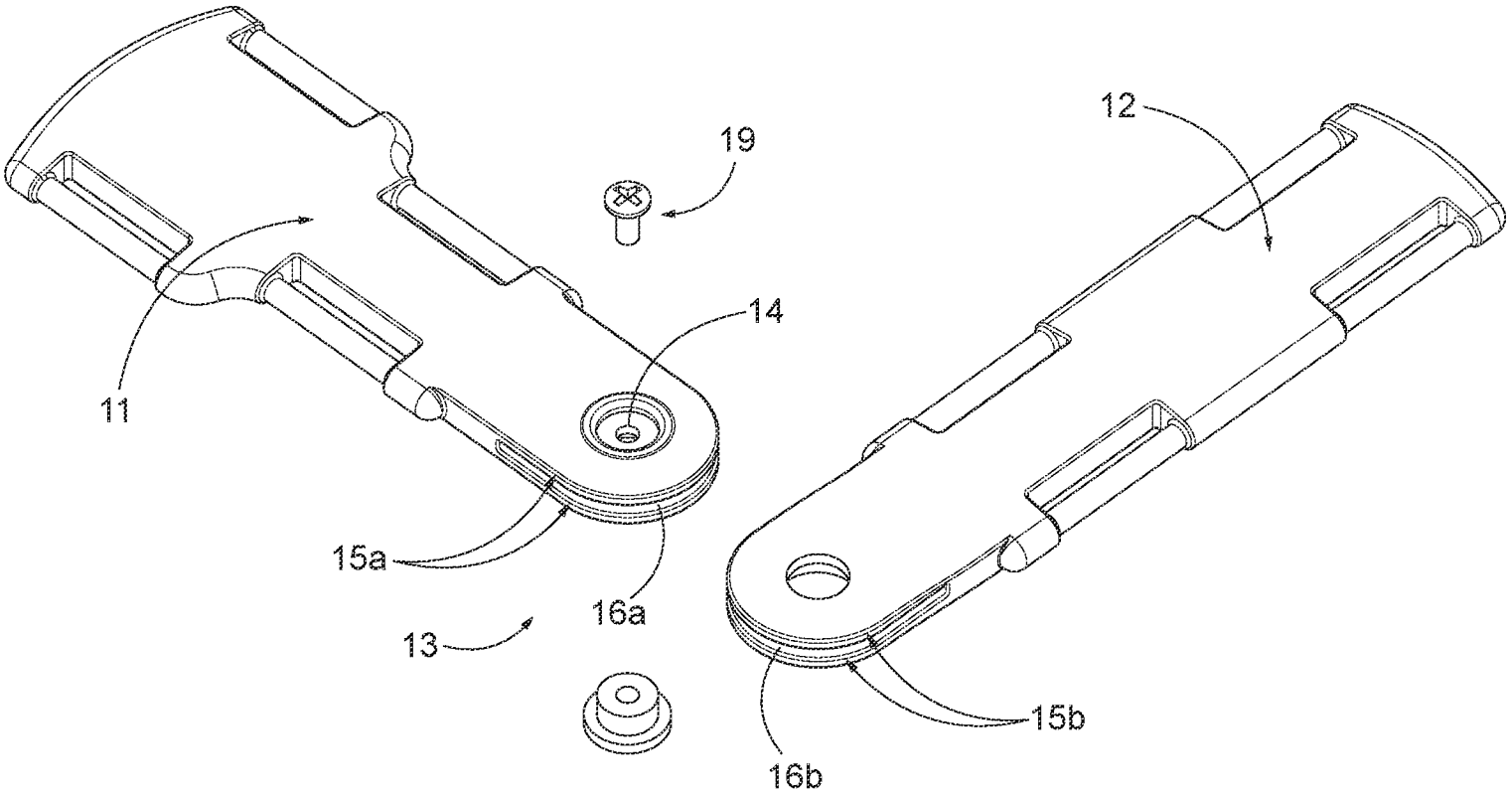
FIG. 4 is an exploded perspective view of the invention.

The pivot joint 13 is more easily seen in the exploded view of FIG. 4. In the embodiment shown in FIG. 4, the pivot joint is formed of two similarly shaped pieces at the facing ends of the first support member 11 and the second support member 12. The end portion of the first support member 11 is formed of two fingers 15*a* which form a slot 16*a* therebetween. The end portion of the second support member 12 is formed of two fingers 15*b* which form a slot 16*b* therebetween. When assembled, the two fingers 15*a* of the first support member 11 slide above and beneath the opposing two fingers 15*b* of the second support member 12. The two support members 11, 12 are then secured by a pin 18 inserted at the pivot point 14.

Figure 5:
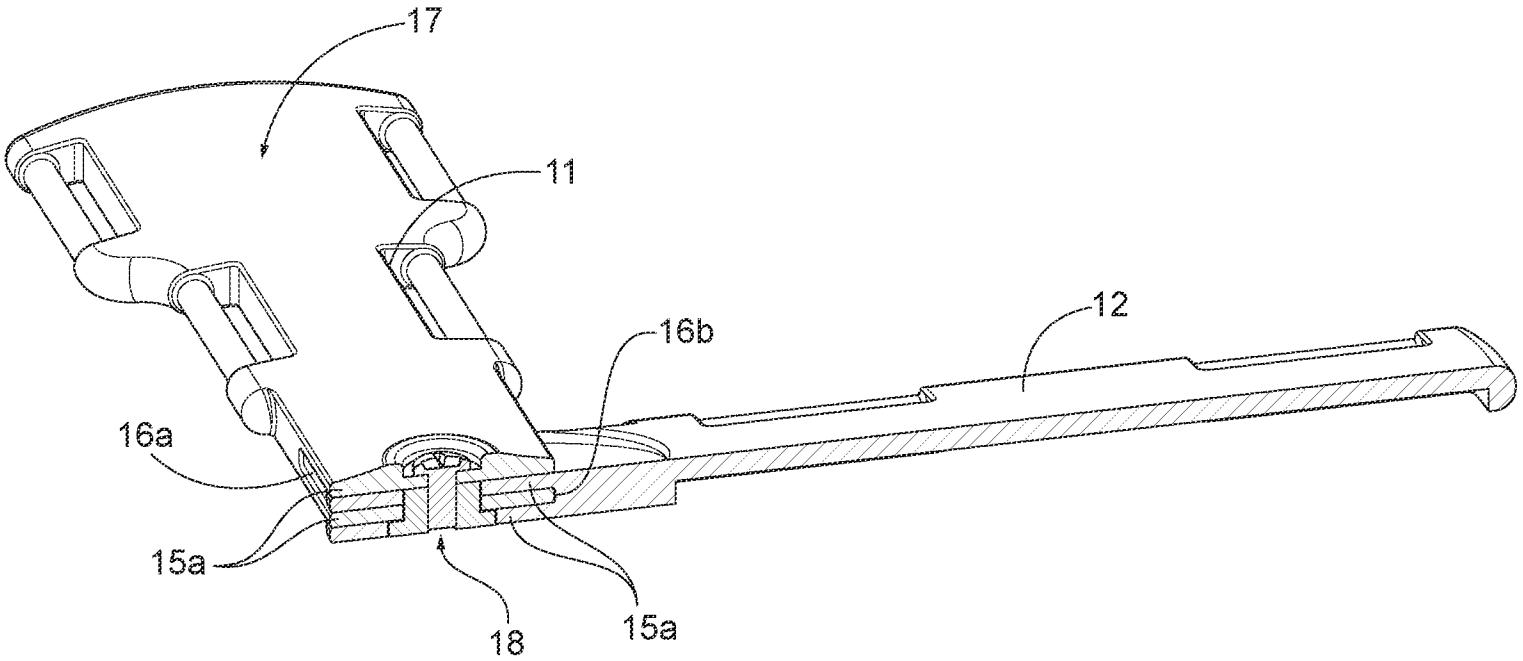
FIG. 5 is a cutaway perspective view of the brace portions of the invention.

As seen in FIGS. 4 and 5, the fingers 15*a* and slot 16*a* of the first support member 11 terminate in an edge at the proximal end of the pivot joint 13. The fingers 15*b* and slot 16*b* of the second support member 12 terminate in an edge at the distal end of the pivot joint 13. When the device is in the L-shape position, the fingers 15*a* of the first support member 11 abut against the edge formed by the slot 16*b* of the second support member 12, and vice-versa for the corresponding components of the other support member) thereby preventing the device from forming an angle more acute than 90°. In this manner, the pivot joint contributes to the function of the invention without requiring resistance bands or straps, or locking hinges.

In a preferred embodiment, the first support member 11 and second support member 12 are formed of a hard polymer material. In an alternative embodiment, the support members may be formed of a lightweight metal, ceramic, or carbon fiber material. In the embodiment of FIGS. 1-5, the pivot joint is comprised of two fingers forming a slot on each support member. In another embodiment, the pivot joint may be comprised of a single finger on the first support member that fits between two fingers (forming a slot) on the second base member, or vice-versa. Although not explicitly listed here, other possible pivot joint arrangements are compatible with this invention and would be understood by a person of ordinary skill in the art.

FIG. 6 depicts the invention being worn on the back arm of a right-handed hitter. As shown here, the hitter 20 has his arms in the ready position before swinging. The device is secured to the upper arm by two straps 18*a* and to the lower arm by two straps 18*b*. The enlarged portion 17 of the device is located at the proximal end of the device. The pivot joint 13 is positioned over the hitter's elbow.

Figure 7:
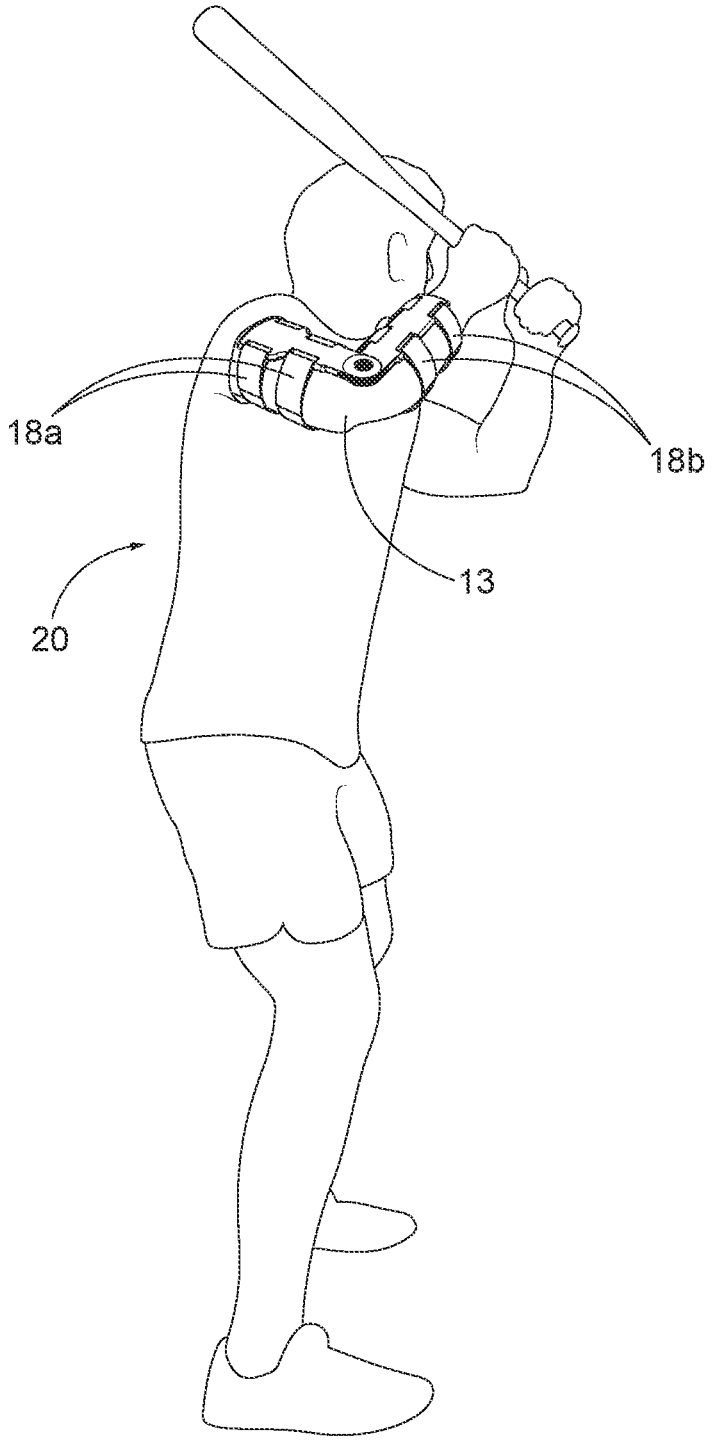
FIG. 7 is a rear view of the invention as worn on the back arm of a right-handed hitter.

FIG. 7 is a rear view of the invention as worn on the back arm of a right-handed hitter. As shown here, the hitter 20 has his arms in the ready position before swinging. The device is secured to the upper arm by straps 18*a* and to the lower arm by straps 18*b*. The enlarged portion 17 of the device is located at the proximal end of the device. The pivot joint 13 is positioned over the hitter's elbow. FIG. 7 depicts the hitter's arms in the proper L-shape, with the forearm and upper arm forming a 90° angle between them. The pivot joint prevents the hitter from extending his hand farther back toward his shoulder at an angle of less than 90°. At the same time, the device does not prevent the hitter from extending his arms out during the swing.

Figure 8:
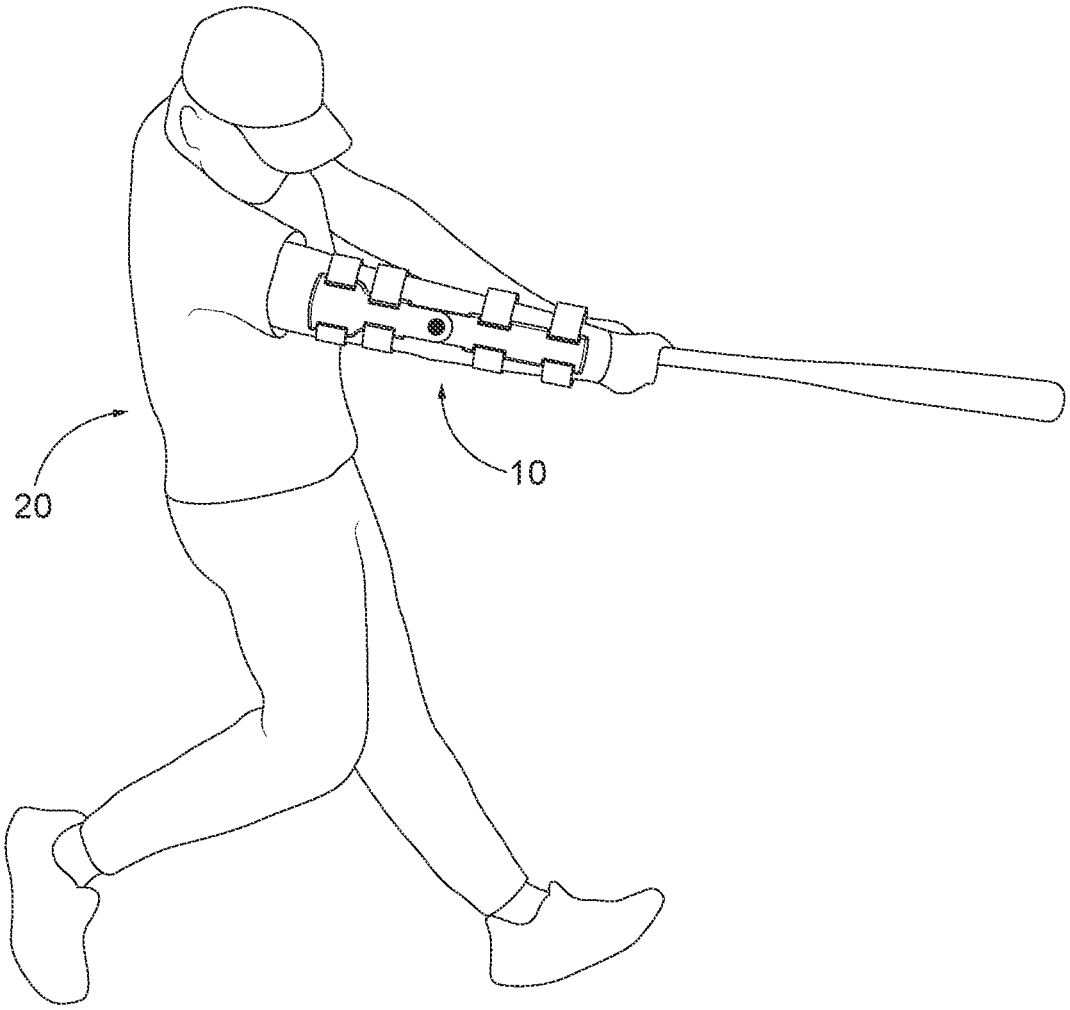
FIG. 8 is a side view of the invention in the extended position as worn on the back arm of a right-handed hitter.

FIG. 8 is a side view of the invention in the extended position as worn on the back arm of a right-handed hitter. As can be seen here, as the hitter 20 swings through the ball, the device 10 allows the hitter's back arm to extend fully out, forming an angle of approximately 180° between the forearm and the upper arm.

Figure 9:
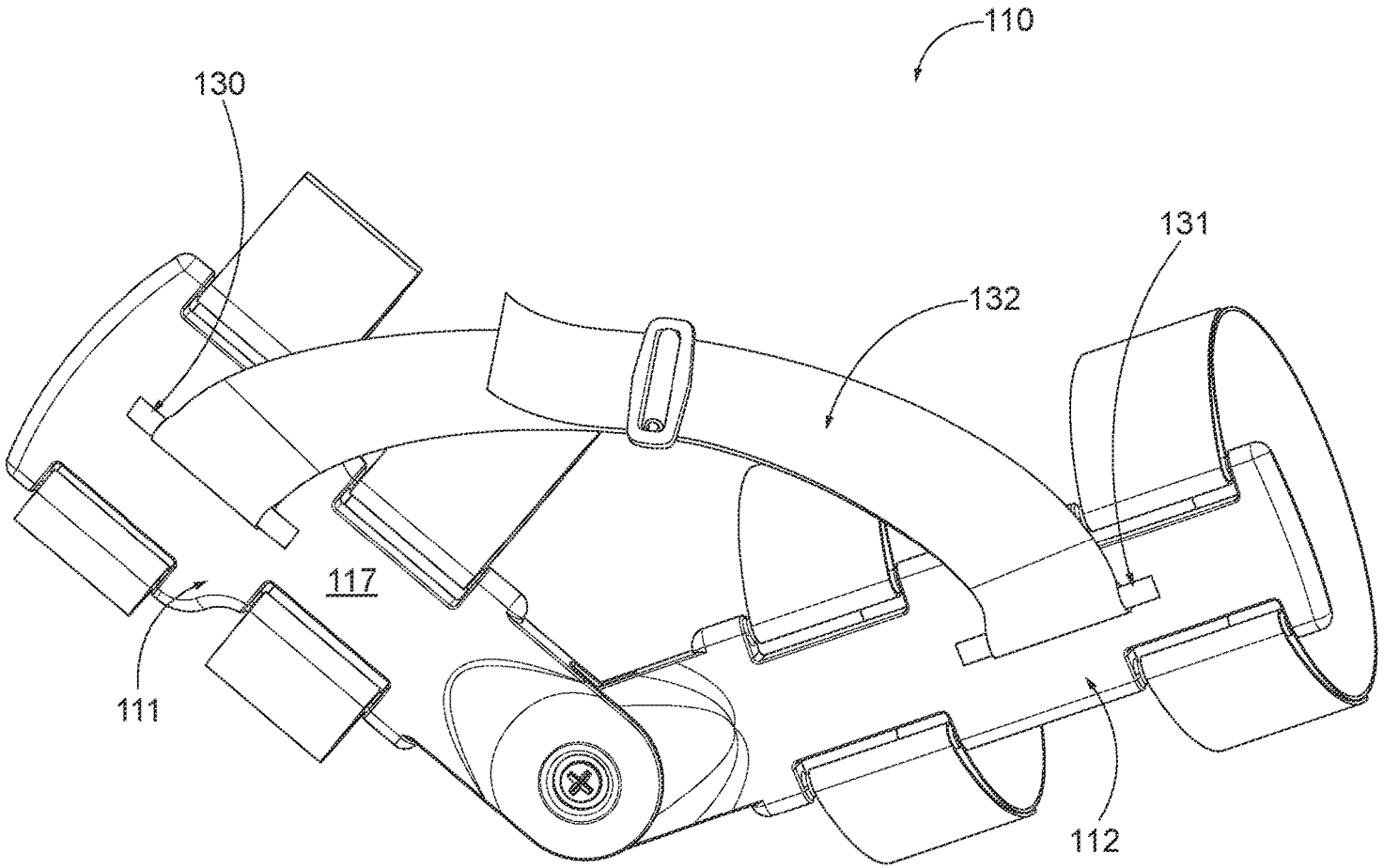
FIG. 9 is a side view of an embodiment of the present invention showing a strap for use with the hitter's front arm.

FIG. 9 is a side view of an embodiment of the present invention showing a strap for use with the hitter's front arm. A flaw often found in a hitter's swing is a tendency for the hitter to lock out the front arm during the swing, known as an arm bar. The hitter's front arm extends out in a straight line away from the body early on in the swing, rather than maintaining the front arm bent at an angle during the swing. The arm bar of the front arm results in the bat path being flat or slightly downward, increasing the likelihood of poor contact. A second bad outcome with front arm bar is increased bat drag, inhibiting acceleration of the bat through the ball. Thus, it is desirable to prevent the front arm from locking out in an arm bar during the swing.

In the embodiment of the invention depicted in FIG. 9, the device 110 is worn on the front arm of the hitter, with the device and front arm forming an L-shape prior to beginning the swing. In this embodiment, the device 110 includes a connecting strap 132 extending between the first support member 111 (worn on the hitter's upper arm) and the second support member 112 (on the hitter's forearm). The strap is positioned and sized such that the device cannot fully extend to form a 180° between the forearm and the upper arm. In various embodiments, the strap 132 is configured to allow the arm to extend out to form an angle of 120°, or 1350 or 150° or 165° angle.

In one embodiment, the connecting strap 132 is attached to the first support member 111 at an attachment point 130 located at the proximal end adjacent to or at the enlarged portion 117 of the first support member 111. A corresponding attachment point 131 is located at the distal end of the second support member 112. Preferably, the strap 132 is removably connected to the device 110 so that it can be disconnected so as not to interfere with the hitter when the device is used on the back arm, or when the strap is not being used. Alternatively, the attachment points may be removable from the device. For example, the attachment points may be connected via a snap, or via a hook and loop strap that can be readily removed by the hitter.

The connecting strap 132 is preferably made of a flexible material that allows the strap to bend and fold, but retains tensile strength sufficient to arrest the hitter's front arm as it extends out during the swing. In one embodiment, the connecting strap 132 may be made of a material with elastic properties that allows the connecting strap 132 to stretch slightly when pulled taught during the swing.

In one embodiment, the connecting strap 132 may be adjustable in length, thereby facilitating different maximum angles of extension. For example, the adjustable connecting strap 132 may be set to, say 6" length to restrict the swing to one maximum extension angle, and it may also be set to multiple other increments, whereby the longer the connecting strap 132 is made to be, the greater the extension angle. In another embodiment, the connecting strap 132 may be a fixed length and one or both of the attachment points 130, 131 may be adjustable in length.

In another embodiment, the strap and the attachment points may be a single item, such that the strap attaches directly to the device without being attached to an intermediate structure. For example, the strap may include snaps at each end of the connection strap, which snaps directly onto receiving snaps on the device.

In each of these embodiments, it is advantageous that the connecting strap and/or the attachment points be allowed to rotate or swivel to some degree during the hitter's swing.

It should be noted that although the description of the invention makes reference to use with a baseball bat, the invention is also advantageously used in training for other sports that require a similar swing, such as softball and other bat sports. While preferred embodiments of the present invention have been described above, it will be obvious to those skilled in the art that such embodiments are provided by way of example only. Numerous variations, changes, and substitutions will now occur to those skilled in the art without departing from the invention. These and other embodiments of the present invention will become apparent to those skilled in the art from a consideration of the following detailed description taken in combination with the accompanying drawings and by the elements, features, and combinations particularly pointed out in the claims.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

The above descriptions of illustrated embodiments of the system, methods, or devices are not intended to be exhaustive or to be limited to the precise form disclosed. While specific embodiments of, and examples for, the system, methods, or devices are described herein for illustrative purposes, various equivalent modifications are possible within the scope of the system, methods, or devices, as those skilled in the relevant art will recognize. The teachings of the system, methods, or devices provided herein can be applied to other processing systems, methods, or devices, not only for the systems, methods, or devices described.

The elements and acts of the various embodiments described can be combined to provide further embodiments. These and other changes can be made to the system in light of the above detailed description.

In general, in the following claims, the terms used should not be construed to limit the system, methods, or devices to the specific embodiments disclosed in the specification and the claims, but should be construed to include all processing systems that operate under the claims. Accordingly, the system, methods, and devices are not limited by the disclosure, but instead the scope of the system, methods, or devices are to be determined entirely by the claims.

While certain aspects of the system, methods, or devices are presented below in certain claim forms, the inventors contemplate the various aspects of the system, methods, or devices in any number of claim forms. Accordingly, the inventors reserve the right to add additional claims after filing the application to pursue such additional claim forms for other aspects of the system, methods, or devices.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An orthotic device comprising:

a first support member having a first end formed of one or more first fingers;

a second support member having a second end formed of one or more second fingers;

a pivot joint centered about the point where the first end of the first support member and the second end of the second support member meet, the pivot joint formed by interleaving the one or more first fingers with the one or more second fingers;

a connecting strap removably connected to the first support member and to the second support member; and one or more retention means for affixing the orthotic device to a user's arm, wherein:

when the orthotic device is worn on the user's arm, the first support member is positioned on the user's upper arm, the second support member is positioned on the user's forearm, and the pivot joint is positioned at a lateral portion of the user's elbow, the arrangement of the one or more first fingers relative to the one or more second fingers in the pivot joint prevent the orthotic device from forming an angle of less than 90° between the first support member and the second support member, and the pivot joint is configured to allow the first support member and the second support member to freely rotate to any angle greater than 90° and less than 180°, as allowed by the connecting strap corresponding, to a swinging motion of the user's arm.

2. The orthotic device of claim 1, wherein the one or more retention means is a strap.

3. The orthotic device of claim 1, wherein the first support member comprises an enlarged portion, wherein the enlarged portion has a width greater than the width of the second support member.

4. The orthotic device of claim 1, wherein the connecting strap is connected to a first attachment point on the first support member and to a second attachment point on the second support member.

5. The orthotic device of claim 1, wherein the connecting strap comprises a stretchable material.

6. The orthotic device of claim 1, wherein the connecting strap is adjustable in length.

* * * * *